US007640970B2

(12) United States Patent
Kim et al.

(10) Patent No.: US 7,640,970 B2
(45) Date of Patent: Jan. 5, 2010

(54) EVAPORATOR USING MICRO-CHANNEL TUBES

(75) Inventors: Jeung Hoon Kim, Suwon-si (KR); Hong Gi Cho, Suwon-si (KR); Seong Ho Kil, Seongnam-si (KR); Keum Nam Cho, Gwacheon-si (KR); Baek Youn, Suwon-si (KR); Hyoung Mo Koo, Anyang-si (KR); Jai Kwon Lee, Suwon-si (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 469 days.

(21) Appl. No.: 11/151,394

(22) Filed: Jun. 14, 2005

(65) Prior Publication Data

US 2006/0054312 A1 Mar. 16, 2006

(30) Foreign Application Priority Data

Sep. 15, 2004 (KR) ..... 10-2004-0073992

(51) Int. Cl.
*F28F 9/26* (2006.01)
*F25B 39/02* (2006.01)

(52) U.S. Cl. ..... 165/144; 165/176; 62/524; 62/526

(58) Field of Classification Search ..... 62/507, 62/511, 524–526, 527; 165/110, 144, 145, 165/146, 150, 176; 138/44
See application file for complete search history.

(56) References Cited

U.S. PATENT DOCUMENTS 2,029,284 A * 2/1936 Armacost ..... 165/145
2,088,931 A * 8/1937 Sengstaken ..... 165/145
2,184,657 A * 12/1939 Young ..... 165/144
5,247,991 A * 9/1993 Polcer ..... 165/145
5,765,393 A * 6/1998 Shlak et al. ..... 62/507
6,116,041 A * 9/2000 Cassell ..... 165/144
2003/0178188 A1 9/2003 Coleman

FOREIGN PATENT DOCUMENTS

| | | |
|---|---|---|
| JP | 1-217959 | 8/1989 |
| KR | 1996-9342 | 7/1996 |
| KR | 2001-20515 | 3/2001 |
| KR | 2001-52935 | 6/2001 |
| KR | 2002-42990 | 6/2002 |
| KR | 2003-63980 | 7/2003 |

(Continued)

OTHER PUBLICATIONS

Patent Abstracts of Japan, Publication No. 03-084395[1], corresponding to Application No. 1-217959, published Apr. 9, 1991.

*Primary Examiner*—Leonard R Leo
(74) *Attorney, Agent, or Firm*—Staas & Halsey LLP

(57) ABSTRACT

An evaporator utilizes micro-channel tubes, and more particularly, has a structure of a heat exchanger using micro-channel tubes, which is applied to an evaporator of a household air conditioner. The evaporator, using micro-channel tubes, includes a first heat exchanging unit including a pair of upper and lower headers, and a plurality of the micro-channel tubes erected vertically between the headers so that condensed water flows downward, and a second heat exchanging unit, installed adjacent to the first heat exchanging unit, includes a pair of upper and lower headers, and a plurality of the micro-channel tubes erected vertically between the headers so that condensed water flows downward. A plurality of return pipes connect upper headers of neighboring heat exchanging units to transmit refrigerant between the neighboring heat exchanging units.

9 Claims, 11 Drawing Sheets

FOREIGN PATENT DOCUMENTS

| | | |
|---|---|---|
| KR | 2004-17447 | 2/2004 |
| KR | 2004-17449 | 2/2004 |
| KR | 2004-17920 | 3/2004 |
| KR | 2004-19628 | 3/2004 |

* cited by examiner

EVAPORATOR USING MICRO-CHANNEL TUBES

CROSS-REFERENCE TO RELATED APPLICATION

This application claims the benefit of Korean Patent Application No. 2004-73992, filed Sep. 15, 2004, in the Korean Intellectual Property Office, the disclosure of which is incorporated herein by reference

BACKGROUND OF THE INVENTION

1. Field of the Invention

The present invention relates to a heat exchanger using micro-channel tubes, and more particularly to a structure of a heat exchanger using micro-channel tubes, which is applied to an evaporator of a household air conditioner.

2. Description of the Related Art

Generally, a heat exchanger using micro-channel tubes is a heat exchanger, in which refrigerant flows along a plurality of tubes having a diameter of less than several mm. Such a heat exchanger is widely used by a condenser of a vehicle air conditioner.

Korean Patent Publication No. 1996-0009342 discloses a structure of a heat exchanger using micro-channel tubes. Hereinafter, with reference to FIG. 1, the heat exchanger using micro-channel tubes will be described.

The heat exchanger using the micro-channel tubes comprises a plurality of tubes 1 laid in a horizontal direction. The tubes 1 are vertically arranged, and corrugated pins 2 are interposed between the tubes 1. Headers 3 and 4 for distributing refrigerant into the tubes 1 or for collecting the refrigerant from the tubes 1 are placed at both ends of the tubes 1. The headers 3 and 4 are made of an aluminum rod member having a circular cross-section, and placed perpendicularly at both ends of the tubes 1. The tubes 1 communicate with the headers 3 and 4, and separators 10 and 11 for dividing the tubes 1 into several channel groups A, B, and C are installed in the headers 3 and 4.

The plural tubes 1 are divided into an inlet-side channel group A, through which the refrigerant enters to the evaporator, an outlet-side channel group C, through which the refrigerant is discharged from the evaporator, and an intermediate channel group B.

With reference to FIG. 2, the overall flow of the refrigerant in the heat exchanger is described. The refrigerant flows along all of the tubes 1 of each of the channel groups A, B, and C in one direction, and then flows along the tubes 1 of the next groups B and C. That is, the refrigerant, having entered into the tubes 1 through a refrigerant inlet 6, is uniformly distributed into all of the tubes 1 of the inlet-side channel group A, and flows toward the upper portion of the right header 4 above the separator 11. In the upper portion of the right header 4 above the separator 11, the inlet-side channel group A and the intermediate channel group B communicate with each other, the entered refrigerant flows toward the intermediate channel group B and is transmitted to the lower portion of the left header 3 below the separator 10. Then, the refrigerant, having been transmitted to the left header 3 through the intermediate channel group B, enters into the lower portion of the right header 4 below the separator 11 through the outlet-side channel group C, and is discharged to the outside through a refrigerant outlet 8.

Here, non-described reference numerals 7 and 9 represent caps for closing the ends of the headers 3 and 4, and non-described reference numerals 13 and 14 represent side plates placed on the outer surfaces of the outermost corrugated pins 2.

In the above-described heat exchanger using micro-channel tubes, the refrigerant in a gaseous state, having entered into the heat exchanger through the refrigerant inlet 6, flows in each of the tubes 1 from the inlet-side channel group A to the outlet-side channel group C, exchanges heat with air in the tubes 1 to be condensed to a liquid state, and the refrigerant in the liquid state is discharged to the outside through the refrigerant outlet 8.

The heat exchanger using micro-channel tubes is called various names, i.e., an aluminum heat exchanger due to the material thereof, a flat tube-type heat exchanger due to the shapes of the tubes thereof, and a PFC (parallel flow condenser) due to the flow of the refrigerant.

The heat exchanger using micro-channel tubes is advantageous in that it has heat transfer efficiency higher than that of a pin tube-type heat exchanger, thereby being miniaturized. However, the heat exchanger using micro-channel tubes cannot be used as an evaporator of a household air conditioner due to several problems, as follows.

Since the evaporator exchanges heat with air of a high temperature rather than air of the temperature thereof, moisture in air is condensed and condensation of water occurs on the surface of the evaporator. In the conventional heat exchanger using micro-channel tubes, which comprises the tubes laid in the horizontal direction, the condensed water formed on the surface of the heat exchanger is gathered in hollow portions of the corrugated pins between the tubes, thus decreasing heat exchanging efficiency.

While the speed of flow of air around the vehicle condenser is comparatively rapid, such as 3~4 m/s, the speed of flow of air around the evaporator of the household air conditioner is comparatively slow, such as 0.5~1.5 m/s, thus reducing a heat transfer rate per unit hour. Accordingly, the conventional heat exchanger using micro-channel tubes requires a large heat transfer area.

While the flow of the refrigerant, flowing in the heat exchanger, from the entrance of the refrigerant into the upper portion of one header to the discharge of the refrigerant from the lower portion of the other header, has an S shape, the refrigerant, flowing in the condenser, is condensed from a gaseous state to a liquid state, thus naturally having an S-shaped flow. As shown in FIG. 2, the number of the tubes 1 of the outlet-side channel group C is smaller than the number of the tubes of the inlet-side channel group A due to the phase change of the refrigerant, thus minimizing pressure loss in the heat exchanger. However, since the refrigerant flowing in the evaporator is vaporized from the liquid state to the gaseous state, it is difficult to apply the channel structure of the condenser to the evaporator.

In spite of the above problems, several methods have been proposed for applying the heat exchanger using micro-channel tubes to an evaporator of a household air conditioner.

Korean Patent Laid-open No. 2003-0063980 discloses a heat exchanger, in which headers are erected horizontally and micro-channel tubes are laid perpendicularly between the headers. Drain holes and line grooves for facilitating the discharge of condensed water are formed in the heat exchanger. Korean Patent Laid-open Nos. 2004-0017447, 2004-0017449, 2004-0017920, and 2004-0019628 disclose structures of heat exchangers for facilitating the discharge of condensed water under the condition that headers and micro-channel tubes are disposed in the same manner as that of the preceding Patent.

As disclosed by the above Patents, an evaporator, in which the headers are erected horizontally and the micro-channel tubes are laid perpendicularly between the headers, can discharge a sufficient quantity of the condensed water, but has disadvantages, such as a small heat transfer area and a difficulty in achieving uniform flow of the refrigerant.

Since the refrigerant at an inlet of the evaporator is in a two-phase state, the refrigerant, which enters into the header of the evaporator, cannot be uniformly distributed to the respective tubes due to the difference of speeds of flow between the gaseous phase and the liquid phase. Particularly, the transmission of the refrigerant from one channel group to another channel group is performed in one header, thus accelerating the above problems.

SUMMARY OF THE INVENTION

Therefore, in an aspect of the invention is to provide an evaporator of a household air conditioner uses compact micro-channel tubes having a high heat transfer efficiency.

In another aspect of the present invention, an evaporator of a household air conditioner uses micro-channel tubes, from which condensed water is easily discharged, and into which refrigerant is uniformly distributed.

In accordance with one aspect of the invention, an evaporator uses micro-channel tubes, and comprises a plurality of heat exchanging units, each heat exchanging unit including a pair of headers and a plurality of the micro-channel tubes installed between the headers, wherein the plural heat exchanging units are connected to communicate refrigerant therebetween.

The micro-channel tubes installed between a pair of headers may be erected vertically so that condensed water flows downward.

A plurality of refrigerant circuits may be formed to comprise a series of channels to facilitate a flow of refrigerant into the evaporator and to facilitate discharge of the refrigerant outside of the evaporator.

Each of the headers may be divided by a plurality of separators so that the micro-channel tubes of each of the heat exchanging units form a plurality of channel groups.

The evaporator may further comprise return pipes to connect the headers of the neighboring heat exchanging units and to transmit refrigerant between the neighboring heat exchanging units.

The channel groups of one heat exchanging unit may be connected to the channel groups of the neighboring heat exchanging unit; and cross-sectional areas of flow channels of a downstream channel group may be greater than or equal to cross-sectional areas of flow channels of an upstream channel group.

In accordance with another aspect of the invention, an evaporator utilizes micro-channel tubes and comprises a first heat exchanging unit that includes a pair of upper and lower headers, and a plurality of the micro-channel tubes erected vertically between the headers so that condensed water flows downward, and a second heat exchanging unit, installed adjacent to the first heat exchanging unit includes a pair of upper and lower headers, and a plurality of the micro-channel tubes erected vertically between the headers so that condensed water flows downward.

Each of the headers of the first and second heat exchanging units may be divided by a plurality of separators so that the micro-channel tubes of each of the first and second heat exchanging units form a plurality of channel groups.

The upper header of the first heat exchanging unit and the upper header of the second heat exchanging unit may be connected by return pipes to communicate the upper headers with each other; one channel group of the first heat exchanging unit and one channel group of the second heat exchanging unit may form one refrigerant circuit; and a plurality of the refrigerant circuits may be prepared.

Inlet pipes, to draw the refrigerant into the evaporator, and outlet pipes, to discharge the refrigerant outside of the evaporator, may be formed through the lower headers of the first and second heat exchanging units.

Cross-sectional areas of flow channels of a channel group located at an inlet of one refrigerant circuit may be greater than or equal to cross-sectional areas of flow channels of a channel group located at an outlet of the refrigerant circuit.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
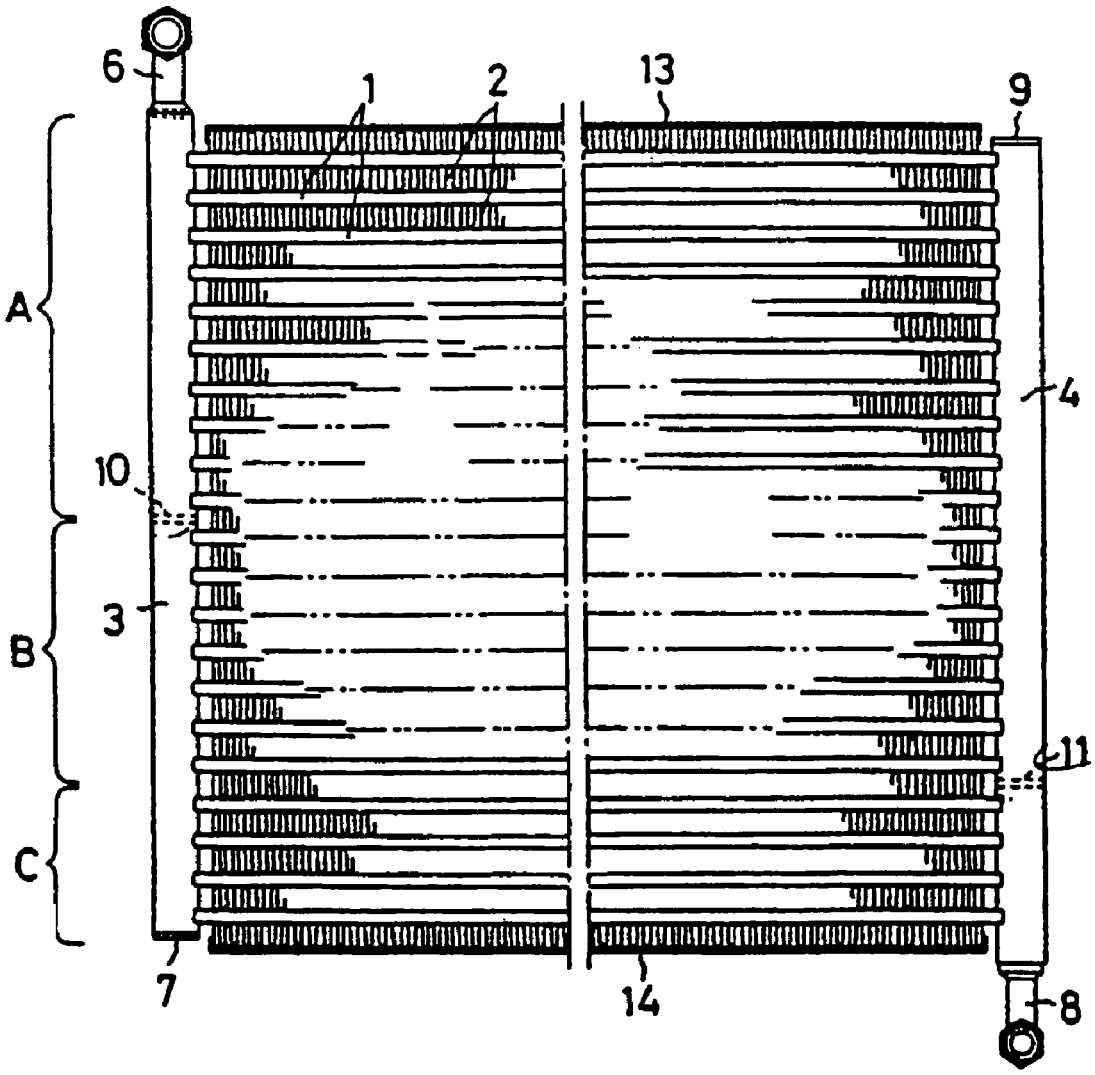
FIG. 1 PRIOR ART
FIG. 1 is a front view of a conventional heat exchanger using micro-channel tubes.
Figure 2:
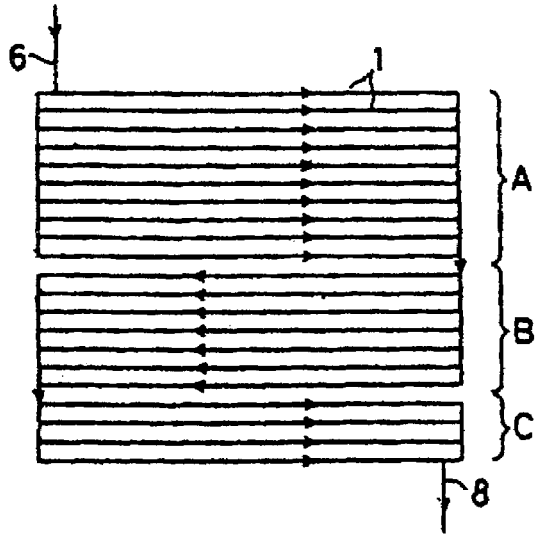
FIG. 2 PRIOR ART
FIG. 2 is a schematic view illustrating the flow of refrigerant in the heat exchanger of FIG. 1.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
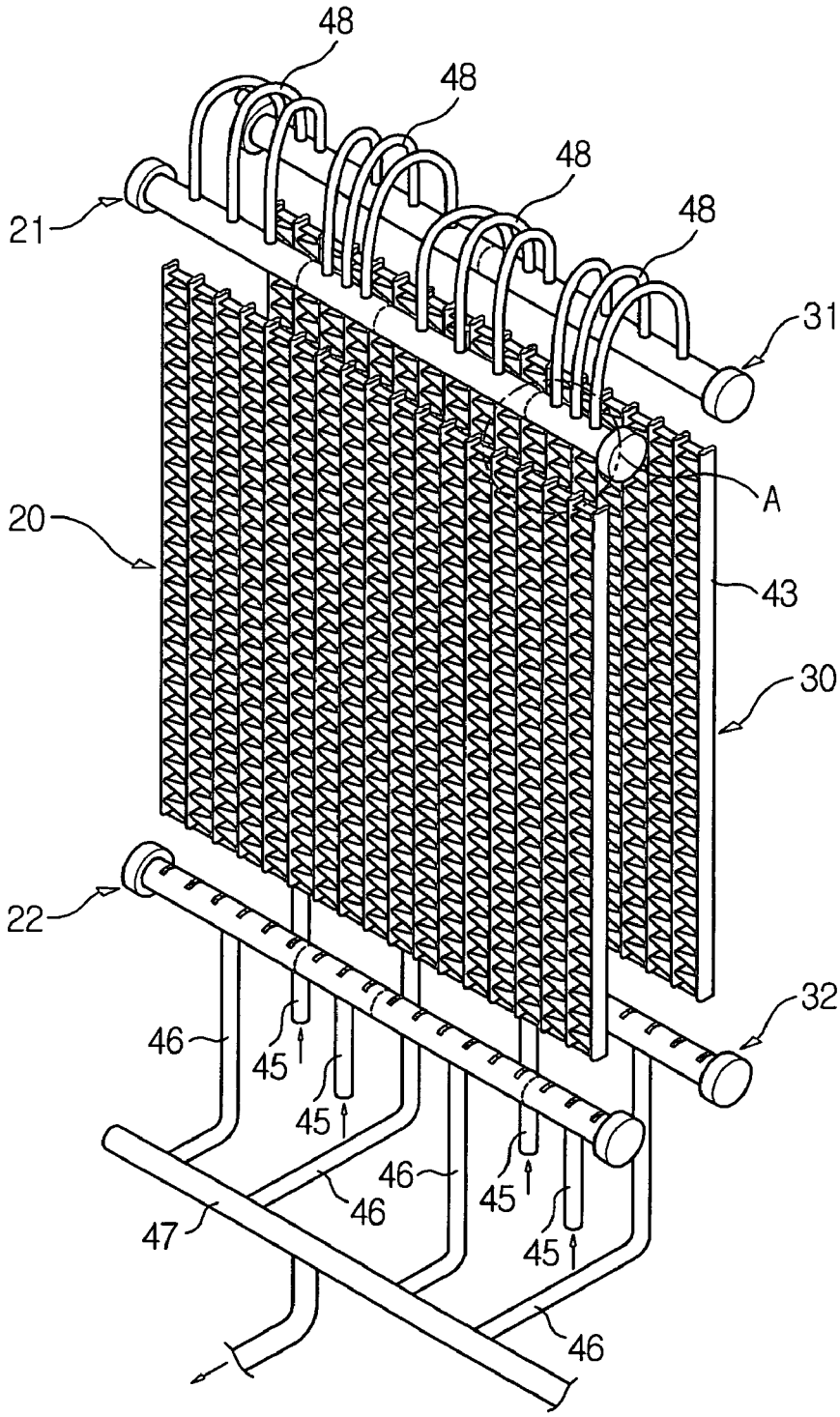
FIG. 3 is an exploded perspective view of an evaporator using micro-channel tubes in accordance with a first embodiment of the present invention.

As shown in FIG. 3, an evaporator using micro-channel tubes in accordance with a first embodiment of the present invention comprises two heat exchanging units 20 and 30, each of which includes a plurality of micro-channel tubes 43 vertically erected between a pair of headers 21 and 22, or 31 and 32, which may be horizontally laid, so that condensed water flows downward. Hereinafter, the heat exchanging unit, which is placed at a front position, is referred to as a first heat exchanging unit 20, and the heat exchanging unit, which is placed at a rear position, is referred to as a second heat exchanging unit 30.

The first heat exchanging unit 20 and the second heat exchanging unit 30 have the same structure.

Figure 4:
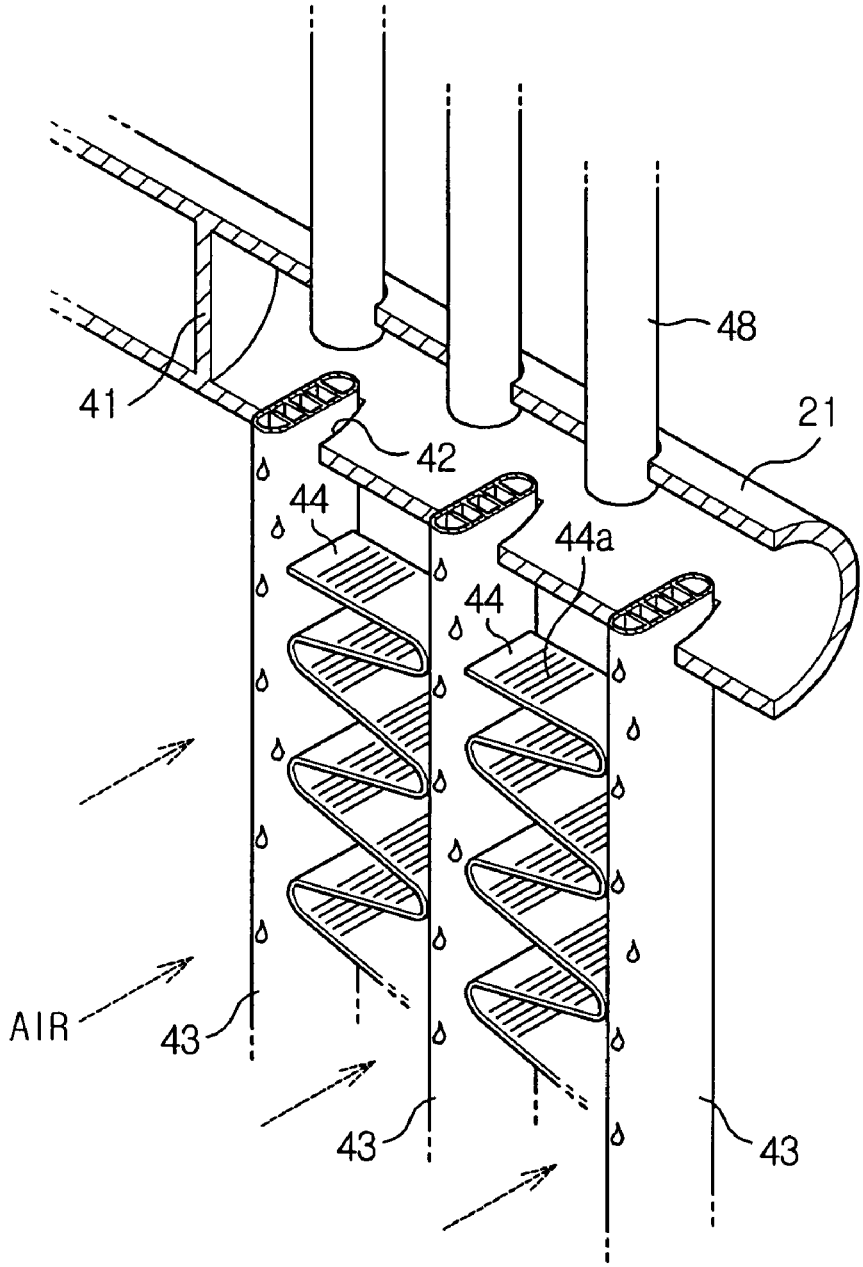
FIG. 4 is an enlarged and exploded perspective view of the portion "A" of FIG. 3.

Hereinafter, with reference to FIGS. 3 and 4, the structure of the first heat exchanging unit 20 will be described in detail. The first upper header 21 having the structure of a pipe with a circular cross-section is placed above the first heat exchanging unit 20. The first upper header 21 is made of aluminum, and the inside of the first upper header 21 is divided by a plurality of separators 41. The separators 41 serve to cut off the flow of refrigerant between neighboring portions of the inside of the first heat exchanging unit 20. Longitudinal holes 42 perpendicular to the longitudinal direction of the first upper header 21 are formed through the lower surface of the first upper header 21 having the pipe structure.

A plurality of the micro-channel tubes (hereinafter, abbreviated to 'tubes') 43 are vertically erected under the lower part of the first upper header 21. The tubes 43 are attached to the first upper header 21 such that designated lengths of upper ends of the tubes 43 are inserted into the longitudinal holes 42. The insides of the tubes 43 are divided into plural portions to form fine channels. Since the cross-sections of the tubes 43 are similar to the structure of a harmonica, the tubes 43 are referred to as harmonica tubes.

Corrugated pins 44 are intercalated between the micro-channel tubes 43. Generally, louvers 44*a* are formed on the corrugated pins 44 to facilitate heat transfer.

Typically, when the evaporator is installed, the surface of the evaporator is perpendicular to the flow direction of air. As shown in FIG. 4, water condensed on the surface of the evaporator flows down along the surfaces of the tubes 43, which are erected vertically, by its own weight. Water condensed on the corrugated pins 44 flows down by the gradient of the corrugated pins 44, and then flows down along the surfaces of the tubes 43 or flows down again along the corrugated pins 44 at contacts between the corrugated pins 44 and the tubes 43.

The first lower header 22 placed below the tubes 43 has the same structure as that of the first upper header 21.

In correspondence with the first heat exchanging unit 20, the second heat exchanging unit 30 includes a second upper header 31, a micro-channel tubes 43, a corrugated pins 44, and a second lower header 32.

Figure 7:
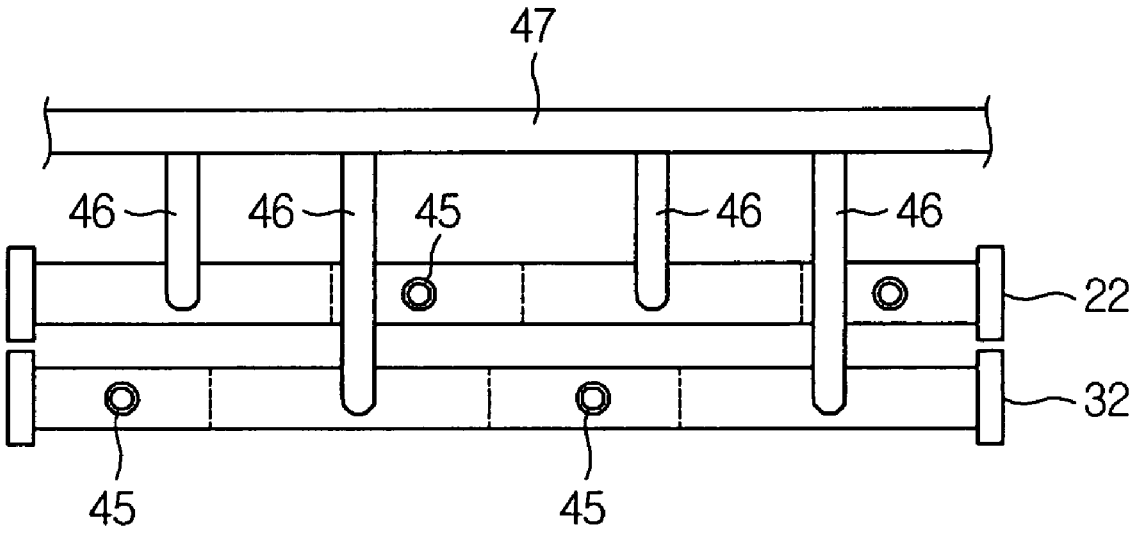
FIG. 7 is a top view of the evaporator using micro-channel tubes in accordance with the first embodiment of the present invention.

Inlet pipes 45, to draw the refrigerant into the evaporator, the refrigerant having passed through an expansion valve (not shown) of the conventional refrigerating cycle, into the evaporator, and outlet pipes 46, to discharge the refrigerant, having been vaporized by the evaporator, to the outside of the evaporator, are connected to the lower portions of the first lower header 22 and the second lower header 32. The refrigerant discharged from the outlet pipes 46 is gathered in a collecting manifold 47 connected to the lower ends of the outlet pipes 46, and is transmitted to a compressor (not shown) (see FIG. 7).

Figure 6:
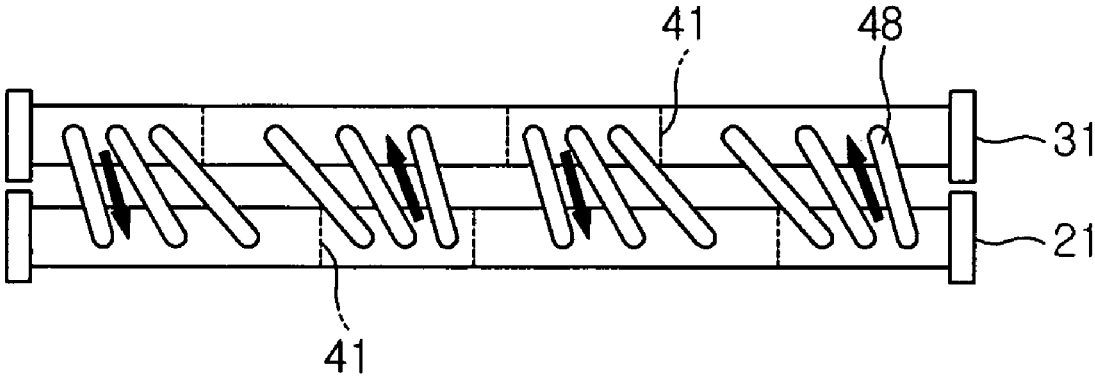
FIG. 6 is a plan view of the evaporator using micro-channel tubes in accordance with the first embodiment of the present invention.

To communicate the refrigerant between the first heat exchanging unit 20 and the second heat exchanging unit 30, the first upper header 21 and the second upper header 31 are connected by a plurality of return pipes 48 (see FIG. 6).

Figure 5:
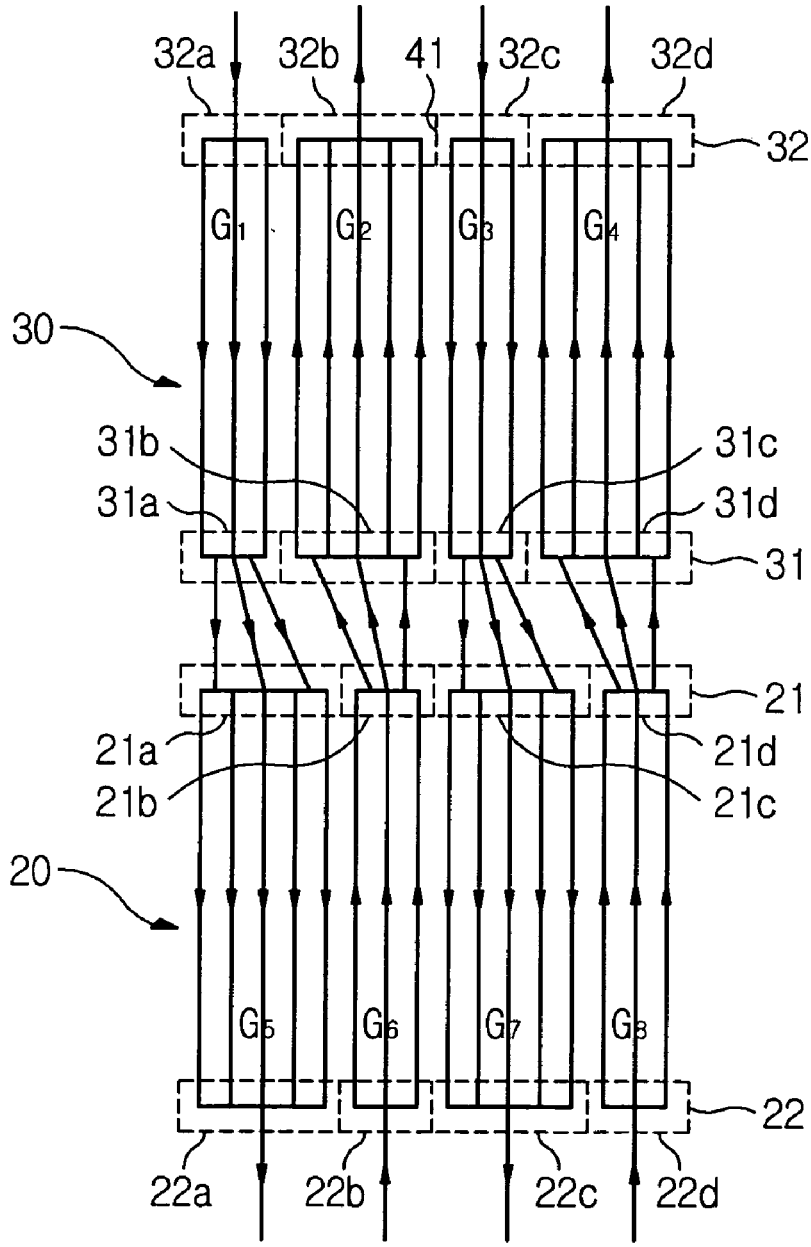
FIG. 5 is a schematic view illustrating the flow of refrigerant in the evaporator using micro-channel tubes in accordance with the first embodiment of the present invention.

Hereinafter, as shown in FIG. 5, the flow of the refrigerant in the evaporator using the micro-channel tubes in correspondence with the first embodiment of the present invention will be described.

An upper portion of FIG. 5 illustrates the flow of the refrigerant in the second heat exchanging unit 30, and a lower portion of FIG. 5 illustrates the flow of the refrigerant in the first heat exchanging unit 20.

As described above, the inside of each of the headers 21, 22, 31, and 32 is divided by a plurality of the separators 41. In the evaporator, in accordance with the first embodiment, the inside of each of the headers 21, 22, 31, and 32 is divided into four portions, and the four portions have different sizes to form the flow of the refrigerant as shown in FIG. 5.

In FIG. 5, a left portion 32*a* of the second lower header 32 and a left portion 31*a* of the second upper header 31 have a same size, and the tubes 43, which are installed between the left portion 32*a* of the second lower header 32 and the left portion 31*a* of the second upper header 31, form one channel group G1. The remaining portions 32*b*, 32*c*, and 32*d* of the second lower header 32 and the corresponding remaining portions of 31*b*, 31*c*, and 31*d* of the second upper header 31, respectively, have the same sizes, and form channel groups G2, G3, and G4. In the same manner as the second lower header 32 and the second upper header 31, the first upper header 21 is divided into four portions 21*a*, 21*b*, 21*c*, and 21*d*, and the first lower header 22 is divided into four portions 22*a*, 22*b*, 22*c*, and 22*d*, and form channel groups G5, G6, G7, and G8, in order.

The number of the tubes 43 of any one of the channel groups G1, G3, G6, and G8 is smaller than a number of the tubes 43 of any one of the channel groups G2, G4, G5, and G7. The above difference of numbers of the tubes 43 among the channel groups G1, G2, G3, G4, G5, G6, G7, and G8 reduces the decrease in the pressure of the refrigerant in the evaporator in consideration of the expanded volume of the refrigerant when the refrigerant is vaporized in the evaporator.

The inlet pipe 45 is connected to the portion 32*a* of the second lower header 32 connected to the channel group G1. The refrigerant, having entered into the second lower header 32 through the inlet pipe 45, is distributed at the portion 32*a* into the tubes 43 of the channel group G1. The divided parts of the refrigerant flowing along the tubes 43 of the channel group G1 are collected at the portion 31*a* of the second upper header 31, and the collected refrigerant is distributed again into the return pipes 48 and is transmitted to the portion 21*a* of the first upper header 21. The refrigerant is divided again into the tubes 43 of the channel group G5 and is transmitted to the portion 22*a* of the first lower header 22. The refrigerant at the portion 22*a* of the first lower header 22 is discharged to the outside through the outlet pipe 46 connected to the portion 22*a*.

When the refrigerant passes through the channel groups G1 and G5, the refrigerant is vaporized by exchanging heat with peripheral air. The channel group G1, through which the refrigerant enters the evaporator, is an inlet-side channel group, and the channel group G5, through which the refrigerant is discharged from the evaporator, is an outlet-side channel group. The route of the refrigerant from one inlet pipe 45 to the opposite outlet pipe 46 is referred to as a refrigerant circuit. In the same manner as the channel groups G1 and G5, the channel groups G3, G6, and G8 are inlet-side channel groups, and the channel groups G2, G4, and G7 are outlet-side channel groups, thus forming three refrigerant circuits. Accordingly, a total of four refrigerant circuits is formed in the evaporator, and the flow directions of the refrigerant of the neighboring refrigerant circuits are opposite to each other. The flow directions are designed in consideration of the difference of the numbers of the tubes 43 among the channel groups G1, G2, G3, G4, G5, G6, G7, and G8.

As described above, the number of the tubes 43 of any one of the channel groups G1, G3, G6, and G8 is smaller than the number of the tubes 43 of any one of the channel groups G2, G4, G5, and G7. The above difference in the numbers of the tubes 43 among the channel groups G1, G2, G3, G4, G5, G6, G7, and G8 denotes that the cross sectional areas of flow channels of the outlet-side channel groups G2, G4, G5, and G7 are greater than the cross-sectional areas of the flow channels of the inlet-side channel groups G1, G3, G6, and G8. Since the evaporator receives the refrigerant in a liquid state and discharges the refrigerant in a gaseous state, generally, the evaporator has the above-described structure to reduce the decrease of the pressure in the evaporator.

When the refrigerant is transmitted from one channel group to the next channel group in the conventional evaporator, since the refrigerant flows in the header and is distributed into the tubes 43, it is difficult to uniformly distribute the refrigerant. In the evaporator, in accordance with this embodiment, since the refrigerant is transmitted through a plurality of the return pipes connecting the headers, the refrigerant may be uniformly distributed.

Figure 8:
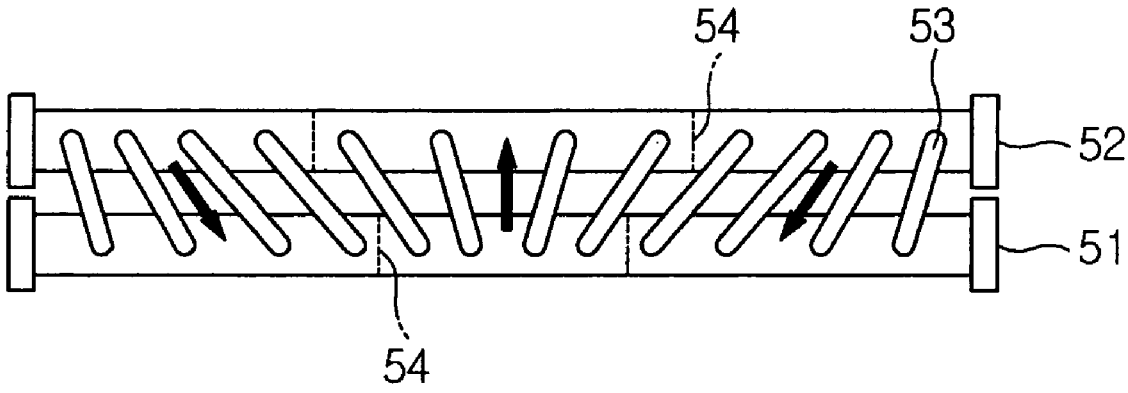
FIG. 8 is a plan view of an evaporator using micro-channel tubes in accordance with a second embodiment of the present invention.

FIG. 8 is a plan view of an evaporator using micro-channel tubes in accordance with a second embodiment of the present invention. In the same manner as the evaporator in accordance with the first embodiment, the evaporator in accordance with the second embodiment comprises two heat exchanging units. However, the evaporator of the second embodiment has a refrigerant channel structure differing from that of the evaporator of the first embodiment. That is, the evaporator of the second embodiment has a total of three refrigerant circuits. Each of a first upper header 51 located at a lower part in FIG. 8 and a second upper header 52 located at an upper part in FIG. 8 is divided into three portions by two separators 54. In the same manner as that of the evaporator of the first embodiment, the cross sectional areas of the flow channels of outlet-side channel groups are greater than the cross-sectional areas of the flow channels of inlet-side channel groups. The first upper header 51 and the second upper header 52 communicate with each other by a plurality of return pipes 53, thus transmitting refrigerant therebetween. The flow directions of the refrigerant of the neighboring refrigerant circuits are opposite to each other, as shown by the arrows.

Figure 9:
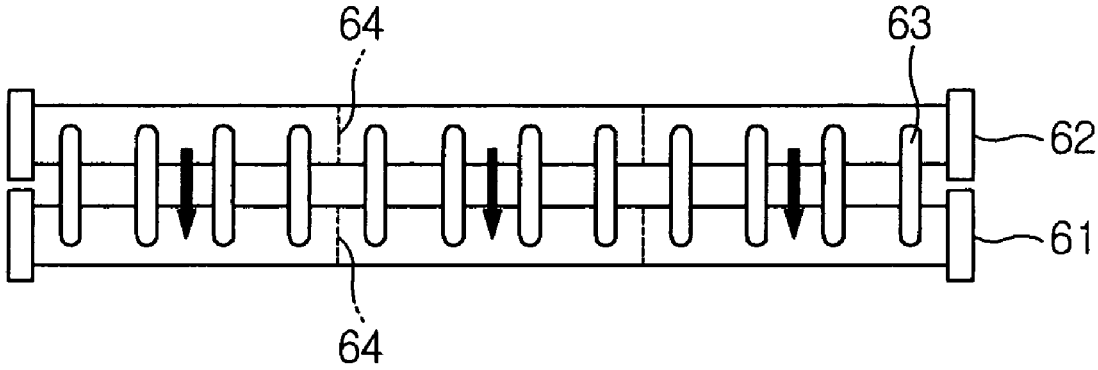
FIG. 9 is a plan view of an evaporator using micro-channel tubes in accordance with a third embodiment of the present invention.

FIG. 9 is a plan view of an evaporator using micro-channel tubes in accordance with a third embodiment of the present invention. In the same manner as the evaporator in accordance with the second embodiment, the evaporator in accordance with the third embodiment comprises three refrigerant circuits. However, the evaporator of the third embodiment differs from the evaporator of the second embodiment in that the cross-sectional areas of the flow channels of outlet-side channel groups are equal to the cross-sectional areas of the flow channels of inlet-side channel groups, and the flow directions of the refrigerant of the respective refrigerant circuits are the same. Each of a first upper header 61 located at a lower part in FIG. 9 and a second upper header 62 located at an upper part in FIG. 9 is divided into three portions by separators 64. The first upper header 61 and the second upper header 62 are connected by a plurality of return pipes 63, thus transmitting refrigerant therebetween. As shown by the arrows, the refrigerant flows from the second upper header 62 to the first upper header 61.

Figure 10:
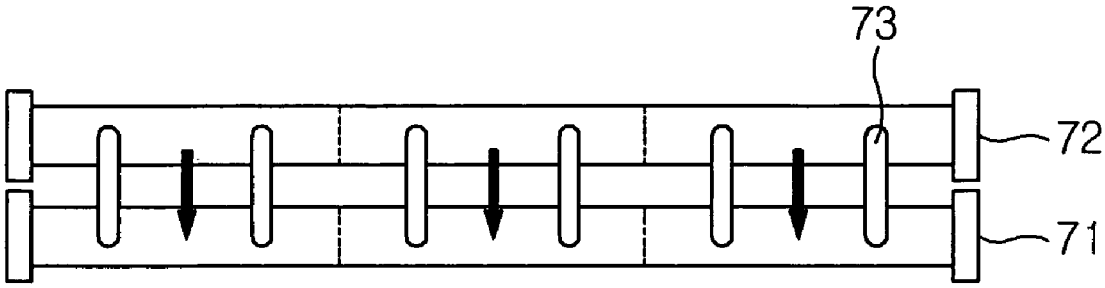
FIG. 10 is a plan view of an evaporator using micro-channel tubes in accordance with a fourth embodiment of the present invention.

FIG. 10 a plan view of an evaporator using micro-channel tubes in accordance with a fourth embodiment of the present invention. In the same manner as the evaporator in accordance with the third embodiment, the evaporator in accordance with the fourth embodiment comprises three refrigerant circuits, and the cross-sectional areas of the flow channels of outlet-side channel groups are equal to the cross-sectional areas of the flow channels of inlet-side channel groups. However, the evaporator of the fourth embodiment differs from the evaporator of the third embodiment in that the number of return pipes 73 for connecting a first upper header 71 and a second upper header 72 of the evaporator of the fourth embodiment is half of the number of the return pipes 63 of the evaporator of the third embodiment.

Figure 11:
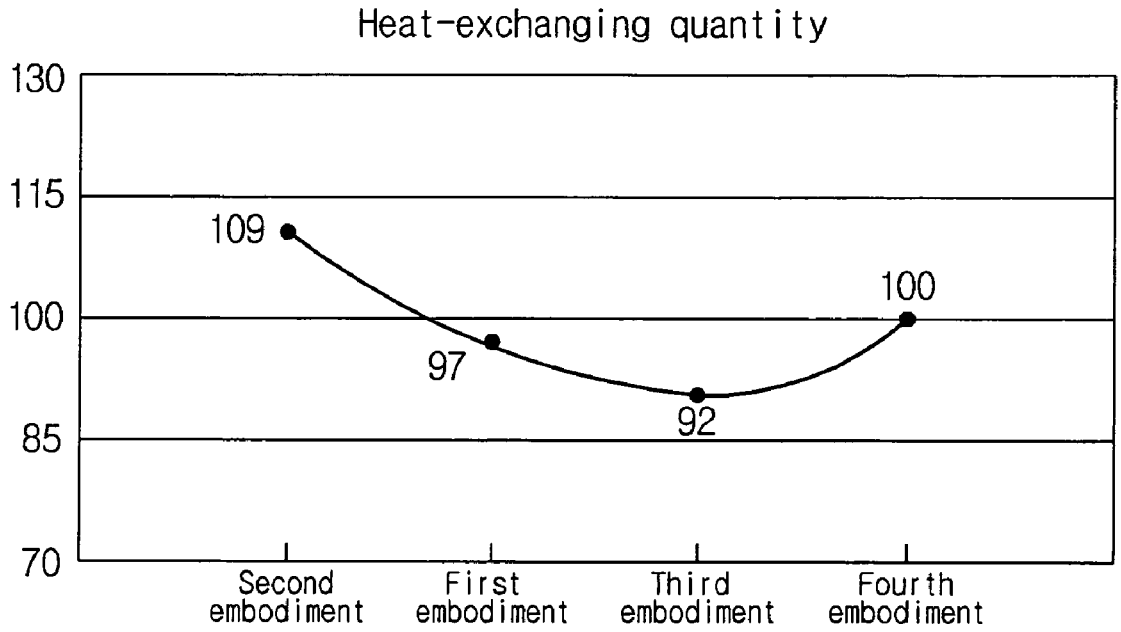
FIG. 11 is a graph illustrating results of a heat transfer efficiency test of the evaporators using micro-channel tubes in accordance with the first, second, third, and fourth embodiments of the present invention.

FIG. 11 is a graph illustrating results of a heat transfer efficiency test (test conditions: Korean Industrial Standard KS C 9306) of the evaporators using micro-channel tubes, which are manufactured to have the same capacity and size, in accordance with the first, second, third, and fourth embodiments of the present invention.

In FIG. 11, values on the X-axis from the left denote the evaporators of the first, second, third, and fourth embodiments, and values on the Y-axis represent the percentages of heat-exchanging quantities of the evaporators of the respective embodiments to the heat-exchanging quantity of the evaporator of the fourth embodiment.

In comparison of the evaporators of the third and fourth embodiments, the number of the return pipes of the evaporator of the third embodiment is double the number of the return pipes of the evaporator of the fourth embodiment, but the heat transfer efficiency of the evaporator of the third embodiment is decreased by 8% when compared with the heat transfer efficiency of the evaporator of the fourth embodiment. This result denotes that the large number of the return pipes is not beneficial to heat transfer efficiency, but the number of the return pipes needs to be adjusted based on the number of the refrigerant circuits or the sizes of the channel groups of the evaporators.

Differing from the evaporator of the fourth embodiment, the evaporator of the second embodiment has cross-sectional areas of the flow channels of outlet-side channel groups that are greater than the cross-sectional areas of the flow channels of inlet-side channel groups. In this case, the heat transfer efficiency of the evaporator of the second embodiment is increased by 9% of the heat transfer efficiency of the evaporator of the fourth embodiment. The evaporator of the first embodiment, in the same manner as the evaporator of the second embodiment, has cross-sectional areas of the flow channels of outlet-side channel groups that are larger than the cross-sectional areas of the flow channels of inlet-side channel groups, and further comprises one refrigerant circuit more than the evaporator of the second embodiment. The heat transfer efficiency of the evaporator of the first embodiment is decreased by 3% of heat transfer efficiency of the evaporator of the fourth embodiment. These results denote that the evaporator in which cross-sectional areas of the flow channels of outlet-side channel groups are greater than the cross-sectional areas of the flow channels of inlet-side channel groups has a high heat exchanging efficiency, and, in order to satisfy the high heat exchanging efficiency, the evaporator requires the proper number of refrigerant circuits.

The headers, the tubes, and the corrugated pins of the above evaporator using micro-channel tubes are made of aluminum material, and manufactured by a furnace brazing process.

As is apparent from the above description, the present invention provides an evaporator using micro-channel tubes, which has a small size and a high efficiency, thus being capable of miniaturizing a household air conditioner.

The evaporator of the present invention comprises a plurality of heat exchanging units, thus having a sufficient heat transfer area.

The evaporator of the present invention uniformly distributes refrigerant by the installed direction thereof and return pipes connecting the heat exchanging units.

The evaporator of the present invention easily discharges condensed water by the installed direction thereof.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An evaporator comprising:

first and second heat exchanger units in series, each first and second heat exchanger unit comprising:

a pair of headers; and a plurality of micro-channel tubes installed vertically between each of the pair of headers; and a plurality of return pipes connecting one of the pair of headers of the first heat exchanger unit to one of the pair of headers of the second heat exchanger unit and forming a refrigerant circuit with refrigerant flowing serially from the first heat exchanger unit to the second heat exchanger unit, through the plurality of return pipes, wherein each of the headers is divided by a plurality of separators, and the separators divide the plurality of micro-channel tubes of each heat exchanging unit into a plurality of micro-channel groups.

2. The evaporator according to claim 1, wherein the evaporator has a plurality of refrigerant circuits each having a separate series of connected micro-channel tubes to facilitate entry of refrigerant into the evaporator and facilitate discharge of refrigerant from the evaporator, and the refrigerant circuits direct refrigerant along different paths.

3. The evaporator according to claim 1, wherein:

cross-sectional areas of downstream micro-channel tubes are greater than or equal to cross-sectional areas of upstream micro-channel tubes.

4. An evaporator, comprising:

a first heat exchanging unit comprising:

a first pair of horizontal upper and lower headers; and a first plurality of micro-channel tubes located vertically between the first pair of upper and lower headers; and a second heat exchanging unit, installed adjacent to the first heat exchanging unit, comprising:

a second pair of horizontal upper and lower headers; and a second plurality of-the micro-channel tubes placed vertically between the second pair of upper and lower headers, wherein each of the headers is divided by a plurality of separators which divide the micro-channel tubes of each of the first and second heat exchanging units into a plurality of micro-channel groups;

at least one bent return pipe connecting the upper header of the first heat exchanging unit to the upper header of the second heat exchanger unit and forming a refrigerant circuit with refrigerant flowing from the first heat exchanging unit to the second heat exchanging unit, wherein the refrigerant in the first and second heat exchanger units serially flows between the first and second heat exchanger units through the at least one bent return pipes, and wherein an inlet pipe draws the refrigerant into the evaporator, and an outlet pipe discharges the refrigerant from the evaporator, and the inlet and outlet pipes are connected to the evaporator through the lower headers respectively of the first and second heat exchanging units.

5. The evaporator according to claim 4, wherein cross-sectional areas of flow channels of one of the micro-channel groups located at an inlet of one refrigerant circuit are greater than or equal to cross-sectional areas of flow channels of another of the micro-channel groups located at an outlet of the refrigerant circuit.

6. A heat exchanging device, comprising:

a plurality of heat exchanging units;

a plurality of-the micro-channel tubes installed vertically between an upper portion and a lower portion of each heat exchanging unit, wherein each of the upper and lower portions is a respective horizontal header divided by a plurality of separators which divide the micro-channel tubes of each of the heat exchanging units into a plurality of micro-channel groups; and a plurality of bent return pipes connecting the upper headers of adjacent heat exchanging units and transmitting refrigerant between the adjacent heat exchanging units, wherein refrigerant in the plurality of heat exchanging units serially flows between a first heat exchanging unit and a second heat exchanging unit through the bent return pipes.

7. A heat exchanger device comprising:

a first heat exchanger unit having a first plurality of micro-channel tubes, a second heat exchanger unit having a second plurality of micro-channel tubes, wherein each heat exchanger unit has a pair of horizontal, upper and lower headers with the respective first and second pluralities of micro-channel tubes running vertically between and connecting each of the headers in the pair of headers; and at least one bent return pipe connecting the first heat exchanger unit to the second heat exchanger unit with refrigerant first flowing through the first plurality of micro-channel tubes and then flowing through the second plurality of micro-channel tubes, wherein the first plurality of micro-channel tubes is positioned parallel to, and in a different plane from, the second plurality of micro-channel tubes, wherein the refrigerant in the heat exchanger units serially flows between the first and second heat exchanger units through the at least one bent return pipe, wherein each of the upper and lower headers is divided by a plurality of separators which divide the micro-channel tubes of each of the heat exchanging units into a plurality of micro-channel groups, and wherein an inlet pipe draws refrigerant into the evaporator, and an outlet pipe discharges refrigerant from the evaporator, and the inlet and outlet pipes are connected to the evaporator through the lower headers respectively of the first and second heat exchanging units.

8. The heat exchanging device according to claim 7, further comprising:

a plurality of refrigerant circuits which form a series of channels of refrigerant to facilitate entry of the refrigerant into the heat exchanging device and facilitate discharge of the refrigerant outside of the heat exchanging device.

9. The heat exchanging device according to claim 7, wherein:

the micro-channel groups of one heat exchanging unit are connected to the micro-channel groups of an adjacent heat exchanging unit; and cross-sectional areas of flow channels of a downstream micro-channel group are greater than or equal to cross-sectional areas of flow channels of an upstream micro-channel group.

* * * * *

UNITED STATES PATENT AND TRADEMARK OFFICE

CERTIFICATE OF CORRECTION

PATENT NO. : 7,640,970 B2
APPLICATION NO. : 11/151394
DATED : January 5, 2010
INVENTOR(S) : Jeung Hoon Kim et al.

It is certified that error appears in the above-identified patent and that said Letters Patent is hereby corrected as shown below:

Column 1, Line 10, after "reference" insert --.--.

Column 9, Line 16, change "unit," to --unit--.

Column 9, Line 41, change "of-the" to --of--.

Column 9, Line 56, change "pipes," to --pipe,--.

Column 10, Line 5, change "of-the" to --of--.

Signed and Sealed this

Thirtieth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,640,970 B2
APPLICATION NO. : 11/151394
DATED : January 5, 2010
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 661 days.

Signed and Sealed this

Twenty-first Day of December, 2010

David J. Kappos

David J. Kappos
*Director of the United States Patent and Trademark Office*